US011208600B2

(12) United States Patent
Huang et al.

(10) Patent No.: US 11,208,600 B2
(45) Date of Patent: Dec. 28, 2021

(54) MIXED PHASE TWO-STAGE HYDROTREATING PROCESSES FOR ENHANCED DESULFURIZATION OF DISTILLATES

(71) Applicant: SAUDI ARABIAN OIL COMPANY, Dhahran (SA)

(72) Inventors: Haitao Huang, Al Khobar (SA); Omer Refa Koseoglu, Dhahran (SA); Youshan Ma, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/703,555

(22) Filed: Dec. 4, 2019

(65) Prior Publication Data

US 2021/0171842 A1 Jun. 10, 2021

(51) Int. Cl.

| | |
|---|---|
| ***C10G 65/04*** | (2006.01) |
| ***C10G 65/12*** | (2006.01) |
| ***C10G 47/34*** | (2006.01) |

(52) U.S. Cl.

CPC ..... *C10G 65/12* (2013.01); *C10G 47/34* (2013.01); *C10G 65/04* (2013.01); (Continued)

(58) Field of Classification Search

CPC .. C10G 65/12; C10G 47/34; C10G 2300/402; C10G 2300/802; C10G 2300/1048; (Continued)

(56) References Cited

U.S. PATENT DOCUMENTS

| | | | |
|---|---|---|---|
| 6,428,686 | B1 | 8/2002 | Ackerson et al. |
| 6,623,622 | B2 | 9/2003 | Gupta |

(Continued)

FOREIGN PATENT DOCUMENTS

| | | | |
|---|---|---|---|
| CN | 103773475 | A | 5/2014 |
| CN | 104419462 | A | 3/2015 |
| WO | 2014/117309 | A1 | 8/2014 |

OTHER PUBLICATIONS

International Search Report issued in corresponding International Application No. PCT/US2020/014956, dated Aug. 7, 2020 (5 pages).

(Continued)

*Primary Examiner* — Michelle Stein

(74) *Attorney, Agent, or Firm* — Osha Bergman Watanabe & Burton LLP

(57) ABSTRACT

A process for hydrotreating a sulfur-containing hydrocarbon feedstock may include producing a hydrotreated effluent by hydrotreating the feedstock in a three-phase trickle reactor to remove a first portion of the sulfur from the feedstock, separating the first hydrotreated effluent to give a hydrogen-containing gaseous fraction and a separated hydrotreated effluent, stripping the separated hydrotreated effluent to give a hydrogen sulfide-containing gaseous fraction and a stripped hydrotreated effluent, saturating the stripped hydrotreated effluent with hydrogen, and hydrotreating the hydrogen-saturated effluent in a two-phase reactor to remove a remaining second portion of the sulfur and produce a second hydrotreated effluent.

20 Claims, 3 Drawing Sheets

(52) U.S. Cl.
CPC ..... *C10G 2300/1048* (2013.01); *C10G 2300/4081* (2013.01); *C10G 2300/42* (2013.01); *C10G 2300/802* (2013.01)

(58) Field of Classification Search
CPC ..... C10G 2300/4081; C10G 65/00; C10G 65/02; C10G 65/04
See application file for complete search history.

(56) References Cited

U.S. PATENT DOCUMENTS

| | | | | |
|---|---|---|---|---|
| 9,365,781 | B2 | 6/2016 | Dindi | |
| 2005/0167334 | A1 | 8/2005 | Galeazzi | |
| 2008/0159928 | A1* | 7/2008 | Kokayeff ..... | C10G 65/04 422/600 |
| 2009/0095655 | A1* | 4/2009 | Kokayeff ..... | C10G 65/12 208/59 |
| 2009/0321310 | A1* | 12/2009 | Kokayeff ..... | C10G 65/02 208/49 |
| 2009/0321319 | A1* | 12/2009 | Kokayeff ..... | C10G 65/04 208/164 |
| 2010/0155294 | A1 | 6/2010 | Kokayeff et al. | |
| 2012/0000824 | A1* | 1/2012 | Dougherty ..... | C10G 65/04 208/210 |
| 2012/0004477 | A1 | 1/2012 | Dougherty et al. | |
| 2012/0004479 | A1* | 1/2012 | Hanks ..... | C10G 65/04 585/256 |
| 2012/0232322 | A1 | 9/2012 | Wilson et al. | |
| 2013/0068657 | A1 | 3/2013 | Dindi et al. | |
| 2017/0211000 | A1* | 7/2017 | Dindi ..... | C10G 65/04 |

OTHER PUBLICATIONS

Written Opinion issued in corresponding International Application No. PCT/US2020/014956, dated Aug. 7, 2020 (6 pages).

* cited by examiner

MIXED PHASE TWO-STAGE HYDROTREATING PROCESSES FOR ENHANCED DESULFURIZATION OF DISTILLATES

BACKGROUND

Hydrotreating processes are used to effect the removal of one or more heteroatoms (such as sulfur, nitrogen, and/or oxygen) from a hydrocarbon-containing feedstock. During hydrotreating processes, unsaturated hydrocarbons such as olefins, alkynes and aromatics may become saturated through reaction with hydrogen. Hydrotreating is performed at elevated temperatures and pressures, and in the presence of a hydrotreating catalyst.

A key use of hydrotreating is in the desulfurization of fuel fractions, such as diesel. However, production of ultra-low sulfur level fuels requires removal of sulfur-containing compounds such as hindered alkylated dibenzothiophenes, which is challenging. Hydrodesulfurization of sulfides, disulfides, thiophenes, benzothiophenes and dibenzothiophenes takes place by breaking the carbon sulfur bond directly. However, the sulfur atoms of alkylated dibenzothiophenes are severely sterically hindered by the two adjacent alkyl groups. Thus, the sulfur cannot be removed by direct carbon-sulfur bond breakage. Instead, one of the aromatic rings in the molecule must be first dearomatized (hydrogenated) in order to make the sulfur atom reachable. After hydrogenation, the carbon-sulfur bond is broken and the sulfur is removed from the molecule.

This process requires extremely severe operating conditions that either requires a lower space velocity of the feed flow that, in turn, decreases the production capacity of the unit, or, an increase the reaction temperature, which shortens the catalyst circle life.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to processes for hydrotreating a sulfur-containing hydrocarbon feedstock, the processes including producing a hydrotreated effluent by hydrotreating the feedstock in a three-phase trickle reactor to remove a first portion of the sulfur from the feedstock, separating the first hydrotreated effluent to give a hydrogen-containing gaseous fraction and a separated hydrotreated effluent, stripping the separated hydrotreated effluent to give a hydrogen sulfide-containing gaseous fraction and a stripped hydrotreated effluent, saturating the stripped hydrotreated effluent with hydrogen, and hydrotreating the hydrogen-saturated effluent in a two-phase reactor to remove a remaining second portion of the sulfur and produce a second hydrotreated effluent.

In another aspect, embodiments disclosed herein relate to processes for hydrotreating a sulfur-containing hydrocarbon feedstock. the processes including producing a first hydrotreated effluent by hydrotreating a mixture of the feedstock and hydrogen in a three-phase trickle reactor to remove a first portion of the sulfur from the feedstock, separating the first hydrotreated effluent to give a hydrogen-containing gaseous fraction and a separated hydrotreated effluent, purifying the hydrogen-containing gaseous fraction to produce a recycled hydrogen stream that is mixed with a second portion of the feedstock, stripping the separated hydrotreated effluent to give a hydrogen sulfide-containing gaseous fraction and a stripped hydrotreated effluent, saturating the stripped hydrotreated effluent with hydrogen that comprises fresh make-up hydrogen; and hydrotreating the hydrogen-saturated effluent in a two-phase reactor to remove a remaining second portion of the sulfur and produce a second hydrotreated effluent.

In a further aspect, embodiments disclosed herein relate to processes for hydrotreating a sulfur-containing hydrocarbon feedstock, the processes including producing a first hydrotreated effluent by hydrotreating the feedstock in a three-phase trickle reactor to remove a first portion of the sulfur from the feedstock, separating the first hydrotreated effluent to give a hydrogen-containing gaseous fraction and a separated hydrotreated effluent, purifying the hydrogen-containing gaseous fraction to produce a first hydrogen stream, stripping the separated hydrotreated effluent to give a hydrogen sulfide-containing gaseous fraction and a stripped hydrotreated effluent, saturating the stripped hydrotreated effluent with hydrogen that comprises at least a portion of the first hydrogen stream, and hydrotreating the hydrogen-saturated effluent in a two-phase reactor to remove a remaining second portion of the sulfur and produce a second hydrotreated effluent.

Other aspects and advantages of the claimed subject matter will be apparent from the following description and the appended claims.

DETAILED DESCRIPTION

Embodiments in accordance with the present disclosure generally relate to processes and systems for the production of low-sulfur petroleum distillates. In one or more embodiments of the present disclosure, the processes and systems comprise a two-stage hydrotreating process scheme which includes a three-phase, trickle bed reactor in the first stage, and a two-phase fixed bed reactor in the second stage.

For the purposes of the present disclosure, accompanying components that are conventionally used in hydrotreating processes, such as air supplies, catalyst hoppers, gas handling apparatus, spent catalyst discharge sub-systems, catalyst replacement sub-systems, valves, temperature sensors, electronic controllers and the like, are not shown or discussed herein for sake of simplicity. One of ordinary skill in the art would appreciate that such components may be included in the embodiments disclosed herein.

Figure 1:
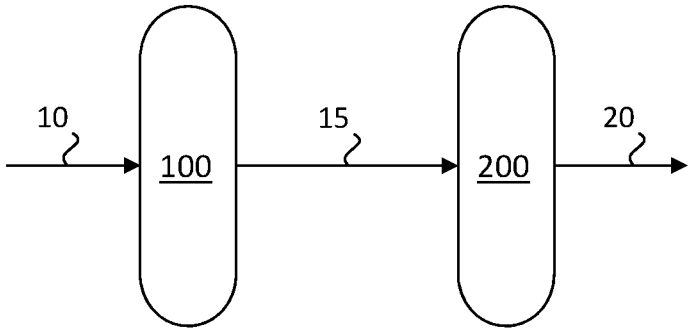
FIG. 1 is a schematic illustration depicting a process of one or more embodiments of the present disclosure.

FIG. 1 depicts a process and system of one or more embodiments of the present disclosure, the system comprising a first-stage hydrotreating reactor 100, and a second-stage hydrotreating reactor 200.

In one or more embodiments, a hydrocarbon feedstock 10 is subjected to a two-stage hydrotreating process. In particular embodiments, the hydrotreating will comprise reducing the amount of sulfur contained by the feedstock 10 through a two-stage hydrodesulfurization process. In one or more embodiments, the first stage 100 comprises the use of a three-phase trickle bed reactor and produces a first hydrotreated effluent 15. The first hydrotreated effluent 15 is then fed to the second hydrotreating stage 200 which, in one or more embodiments, uses a two-phase reactor and provides a second hydrotreating effluent 20. In one or more embodiments, the first hydrotreated effluent 15 may be subjected to one or more processing steps before being fed to the second hydrotreating reactor 200. The processing steps of one or more embodiments may include one or more of cooling, separating, and stripping. Examples of these processing steps will be discussed in more detail elsewhere in the present disclosure.

The hydrocarbon feedstock 10 of one or more embodiments may generally be a middle distillate feedstock. In some embodiments, the feedstock 10 may be a middle distillate blend that comprise more than one middle distillates. In one or more embodiments, the feedstock may comprise one or more fractions selected from naphtha, kerosene, and diesel. In particular embodiments, the distillate feedstock may comprise kerosene and diesel fractions. The feedstock of some embodiments may further comprise vacuum gas oil (VGO) components such as light vacuum gas oil (LVGO). The hydrocarbon feedstock 10 of one or more embodiments may be atmospheric and/or vacuum distillates and may be selected from one or more of jet fuel, kerosene, straight run diesel, light cycle oil, light coker gas oil, gas oil, and combinations of two or more thereof.

In one or more embodiments, the hydrocarbon feedstock 10 may have an initial boiling point of any of 150, 160, 170, 180, 190, 200, and 220° C., and a final boiling point of any of 350, 360, 370, 375, 380, 390, 400, 410, and 430° C. In one or more embodiments, the feedstock 10 in accordance with the present disclosure may be a hydrocarbon fraction having a boiling point ranging from about 150 to 400° C. In further embodiments, the feedstock 10 in accordance with the present disclosure may be a hydrocarbon fraction having a boiling point ranging from about 180 to 370° C.

The hydrocarbon feedstock 10 of one or more embodiments may contain undesirably high amounts of one or more of sulfur, nitrogen, and aromatic components. The meaning of the term "undesirably high" refers to an amount that is too great for the intended purpose of the resulting product, as would be understood by one of ordinary skill in the art.

In one or more embodiments the hydrocarbon feedstock may have sulfur content of 1000 parts per million by weight (ppmw) or more, 2500 ppmw or more, 5000 ppmw or more, 7500 ppmw or more, 10000 ppmw or more, or 15000 ppmw or more. In one or more embodiments, the hydrocarbon feedstock may have nitrogen content of ppmw or more, 150 ppmw or more, 200 ppmw or more, 250 ppmw or more, 300 ppmw or more, or 500 ppmw or more In one or more embodiments, the first stage reactor 100 in accordance with the present disclosure may be a trickle bed reactor that comprises a fixed bed of solid catalyst. The reactor may have the catalyst loaded in one or more catalyst beds. In one or more embodiments, the feedstock 10 is mixed with hydrogen gas and heated. The mixed two-phase feedstock 10 flows into the reactor 100, such that liquid feedstock, gas phase hydrogen and solid phase catalyst are present, making the reactor a three-phase reactor. In one or more embodiments, the hydrogen gas phase and liquid feedstock 10 flow concurrently downward through the fixed bed of catalyst particles.

In a trickle bed reactor of one or more embodiments, the reactor bed is fixed and the hydrogen gas is transported from the gas phase to the liquid phase across the gas/liquid interphase. Hydrogen is transported through the liquid phase to the external surface of the catalyst, where it is adsorbed at an active site. The hydrogen reacts in the liquid phase with the hydrocarbon molecules, which are also adsorbed at the active site. As the hydrogen is consumed in the liquid phase, more hydrogen is dissolved from the excess gas phase hydrogen.

In the first-stage hydrotreating reactor 100 of one or more embodiments, sulfur and nitrogen are removed from the feedstock through hydrogenation/hydrogenolysis to form $H_2S$ and $NH_3$. In the first stage of one or more embodiments, mild reaction conditions, such as low temperature and high flow rate (LHSV), may be used to remove a substantial portion of the sulfur and nitrogen that is contained in the feedstock. In one or more embodiments, most sulfur will be removed except for the most refractory sulfur compounds (such as hindered alkylated dibenzothiophenes).

In one or more embodiments, the first-stage hydrotreating 100 of the present disclosure may be performed at a reaction temperature ranging from about 250° C. to 450° C. In further embodiments, the first-stage hydrotreating 100 may be performed at a temperature ranging from a lower limit of any of 250, 275, 300, 320, 350, and 380° C., to an upper limit of any of 280, 300, 320, 340, 360, 380, 400, 420 and 450° C., where any lower limit may be used in combination with any mathematically-compatible upper limit.

In one or more embodiments, the first-stage hydrotreating 100 of the present disclosure may be performed at a hydrogen partial pressure of about 20 $kg/cm^2$ to about 100 $kg/cm^2$. In further embodiments, the first-stage hydrotreating 100 may be performed at a hydrogen partial pressure ranging from a lower limit of any of 20, 25, 30, and 35 $kg/cm^2$, to an upper limit of any of 30, 35, 40, 45, 60, 80, and 100 $kg/cm^2$, where any lower limit may be used in combination with any mathematically-compatible upper limit.

In one or more embodiments, the first-stage hydrotreating 100 of the present disclosure may be performed at a liquid hourly space velocity (LHSV) of about 0.5 to 5 $h^{-1}$. In further embodiments, the first-stage hydrotreating 100 may be performed at a LHSV ranging from a lower limit of any of 0.5, 1.0, 1.25, 1.5, 1.75, 2.0, and 3.0 $h^{-1}$, to an upper limit of any of 1.5, 2.0, 3.0 4.0, and 5.0 $h^{-1}$, where any lower limit may be used in combination with any mathematically-compatible upper limit.

In one or more embodiments, the first-stage hydrotreating 100 of the present disclosure may be performed with a hydrogen/oil ratio of about 100 normalized $m^3$ per $m^3$ ($Nm^3/m^3$) to about 1000 $Nm^3/m^3$. In further embodiments, the first-stage hydrotreating 100 may be performed at a hydrogen/oil ratio ranging from a lower limit of any of 100, 200, 250, 300, and 400 $Nm^3/m^3$, to an upper limit of any of 350, 450, 600, 800, and 1000 $Nm^3/m^3$, where any lower limit may be used in combination with any mathematically-compatible upper limit.

In one or more embodiments, the first-stage hydrotreating 100 of the present disclosure involves the use of one or more catalysts. As used herein, hydrotreating catalysts primarily effect the removal of one or more heteroatoms (such as sulfur, nitrogen, and/or oxygen) from a hydrocarbon-containing feedstock. During hydrotreating processes, unsaturated hydrocarbons such as olefins, diolefins, alkynes and aromatics may become saturated through reaction with hydrogen. In one or more embodiments of the present disclosure, the hydrotreating catalyst used may be any suitable catalyst that is known to one of ordinary skill in the art. In one or more embodiments, when cracked feedstocks are processed in the first-stage hydrotreating 100, a diolefin hydrogenation reactor may be added upstream of the reactor and/or a special catalyst bed may be installed at the top of the hydrotreating reactor to ensure hydrogenation of, respectively, the diolefins and olefins.

In one or more embodiments, at least one catalyst of the first-stage hydrotreating process 100 is a hydrotreating catalyst. A hydrotreating catalyst of one or more embodiments may comprise a hydrogenative metal component and a support component. The metal of one or more embodiments may be one or more non-precious metals. In some embodiments, the metal may be selected from the group consisting of nickel, cobalt, molybdenum, and tungsten. In particular embodiments, the catalysts for use in the hydrotreating process 100 of one or more embodiments may be one or more combinations of metals selected from the group consisting of nickel-molybdenum (NiMo), cobalt-molybdenum (CoMo), nickel-tungsten (NiW), cobalt-tungsten (CoW) and tri-metal catalysts, including CoMoNi. The support of one or more embodiments may be a mono- or mixed metal oxide. In some embodiments, the support may be one or more of the group consisting of alumina, silica, titania, and zirconia. The catalyst of one or more embodiments may be a commercially available hydrotreating catalyst.

In one or more embodiments, the first-stage hydrotreating process 100 may use a catalyst that is in particulate form. In some embodiments, the catalyst may be shaped particles such as cylinders, pellets, spheres, cloverleaf, trilobe, quadlope, rectangular- and triangular-shaped tubes. In one or more embodiments, the shaped catalyst particles may be 0.25 to about 15 mm, or in some embodiments about 0.80 to 6.5 mm, in diameter when a packed bed reactor is used. In one or more embodiments, the catalyst may be sulfided by contacting it with a sulfur-containing compound at a temperature of greater than 220° C. The catalyst may be sulfided before use or during a hydrotreating reaction.

The first-stage hydrotreating process of one or more embodiments yields a first hydrotreated effluent stream 15. In one or more embodiments, the stream 15 comprises a liquid hydrocarbon product that contains dissolved hydrogen sulfide and, optionally, ammonia that is produced from the hydrotreating of the sulfur and/or nitrogen components of the feedstock 10. The stream 15 of one or more embodiments also contains dissolved hydrogen gas that is carried through from the hydrotreating process 100. In some embodiments, the hydrogen, hydrogen sulphide, and ammonia will be removed from the stream 15 by a suitable process, such as separating or stripping (not shown in FIG. 1).

After removal of hydrogen sulfide, the first hydrotreated effluent stream 15 of one or more embodiments may have a significantly lower sulfur content than the feedstock 10. In one or more embodiments, the stream 15 may have a sulfur content ranging from a lower limit of any one of 1, 10, 20, 50, and 100 ppmw to an upper limit of any of 500, 700, 800, 900, and 1000 ppmw, where any lower limit may be used in combination with any mathematically-compatible upper limit. In one or more embodiments, the maximum sulfur content of the first hydrotreated effluent stream 15 may be related to its hydrogen solubility. Because hydrogen solubility is thermodynamically limited, and the second-stage hydrotreating reactor is two-phase, there is necessarily a limited hydrogen supply. However, if more hydrogen can be dissolved in the second reactor feedstock, the requirements of the hydrodesulfurization in the first reactor 100 can be relaxed and the first hydrotreated effluent stream 15 may have a greater sulfur content.

The first hydrotreated effluent stream 15 of one or more embodiments is fed to a second-stage hydrotreating reactor 200. In one or more embodiments, the stream 15 is saturated with hydrogen gas at the same pressure of the second reactor 200.

The second-stage hydrotreating reactor 200 of one or more embodiments is a two-phase hydrotreating reactor, which has a liquid-full reaction zone having substantially no gas phase hydrogen. In one or more embodiments, the second-stage hydrotreating reactor 200 contains not more than 5%, not more than 1%, or 0% hydrogen by volume in the gas phase. Excess hydrogen gas may be removed from the liquid stream prior to feeding to a catalyst bed.

In one or more embodiments, the second-stage hydrotreating reactor 200 may comprise a solid catalyst that is packed in the reactor in a fixed bed. The hydrogen saturated hydrocarbon liquid may flow through the catalyst bed downward or upward. Under the reaction conditions of one or more embodiments, only the liquid phase reactant contacts with the solid catalyst and hydrodesulfurization reactions occurs on the surface of the catalyst. In the second-stage hydrotreating process 200 of one or more embodiments, the more refractory sulfur components (such as alkylated dibenzothiophenes) are removed from the stream 15 through hydrogenation and hydrogenolysis. In one or more embodiments, the conditions of the second-stage hydrotreating process 200 may be selected as to most efficaciously remove the remaining sulfur components from the feedstock 15.

In one or more embodiments, the catalysts used in the second-stage hydrotreating 200 of the present disclosure are not particularly limited, and may be selected from those discussed above with regard to the first-stage hydrotreating process 100.

In one or more embodiments, the second-stage hydrotreating 200 of the present disclosure may be performed at a reaction temperature ranging from about 100° C. to 500° C. In further embodiments, the first-stage hydrotreating 100 may be performed at a temperature ranging from a lower limit of any of 100, 150, 200, 250, 275, 300, and 400° C., to an upper limit of any of 280, 300, 320, 340, 360, 380, 400, and 500° C., where any lower limit may be used in combination with any mathematically-compatible upper limit. In particular embodiments, the second-stage hydrotreating 200 may be performed at the same or a slightly higher temperature than the first-stage hydrotreating 100.

In one or more embodiments, the second-stage hydrotreating 200 of the present disclosure may be performed at a pressure of about 10 $kg/cm^2$ to about 100 $kg/cm^2$. In further embodiments, the first-stage hydrotreating 100 may be performed at a pressure ranging from a lower limit of any of 10, 15, 20, 25, 30, and 35 $kg/cm^2$, to an upper limit of any of 20, 25, 30, 35, 40, 45, 60, 80, and 100 $kg/cm^2$, where any lower limit may be used in combination with any mathematically-compatible upper limit.

In one or more embodiments, the second-stage hydrotreating 200 of the present disclosure may be performed at a LHSV of about 1 to 5 $h^{-1}$. In further embodiments, the first-stage hydrotreating 100 may be performed at a LHSV ranging from a lower limit of any of 1.0, 1.25, 1.5, 1.75, 2.0, and 3.0 $h^{-1}$, to an upper limit of any of 1.5, 2.0, 3.0 4.0, and 5.0 $h^{-1}$, where any lower limit may be used in combination with any mathematically-compatible upper limit. In particular embodiments, the second-stage hydrotreating 200 may be performed at a higher LHSV than the first-stage hydrotreating 100.

In one or more embodiments, the second-stage hydrotreating 200 of the present disclosure may be performed with a hydrogen/oil ratio of about 1 normalized $m^3$ per $m^3$ ($Nm^3/m^3$) to about 100 $Nm^3/m^3$. In further embodiments, the first-stage hydrotreating 100 may be performed at a hydrogen/oil ratio ranging from a lower limit of any of 1, 5, 10, 20, 40, 60, and 80 $Nm^3/m^3$, to an upper limit of any of 10, 30, 50, 70, 90, and 100 $Nm^3/m^3$, where any lower limit may be used in combination with any mathematically-compatible upper limit.

The second-stage hydrotreating process 200 produces a second hydrotreated effluent stream 20. In some embodiments, the stream 20 may be treated by a suitable process known to one of ordinary skill in the art.

The second hydrotreated effluent stream 20 of one or more embodiments may have a significantly lower sulfur content than the feedstock 10 and the first hydrotreated effluent stream 15. In one or more embodiments, the stream 20 may have a sulfur content of less than 100 ppmw, of less than 10 ppmw, of less than 5 ppmw, or of less than 1 ppmw.

Figure 2:
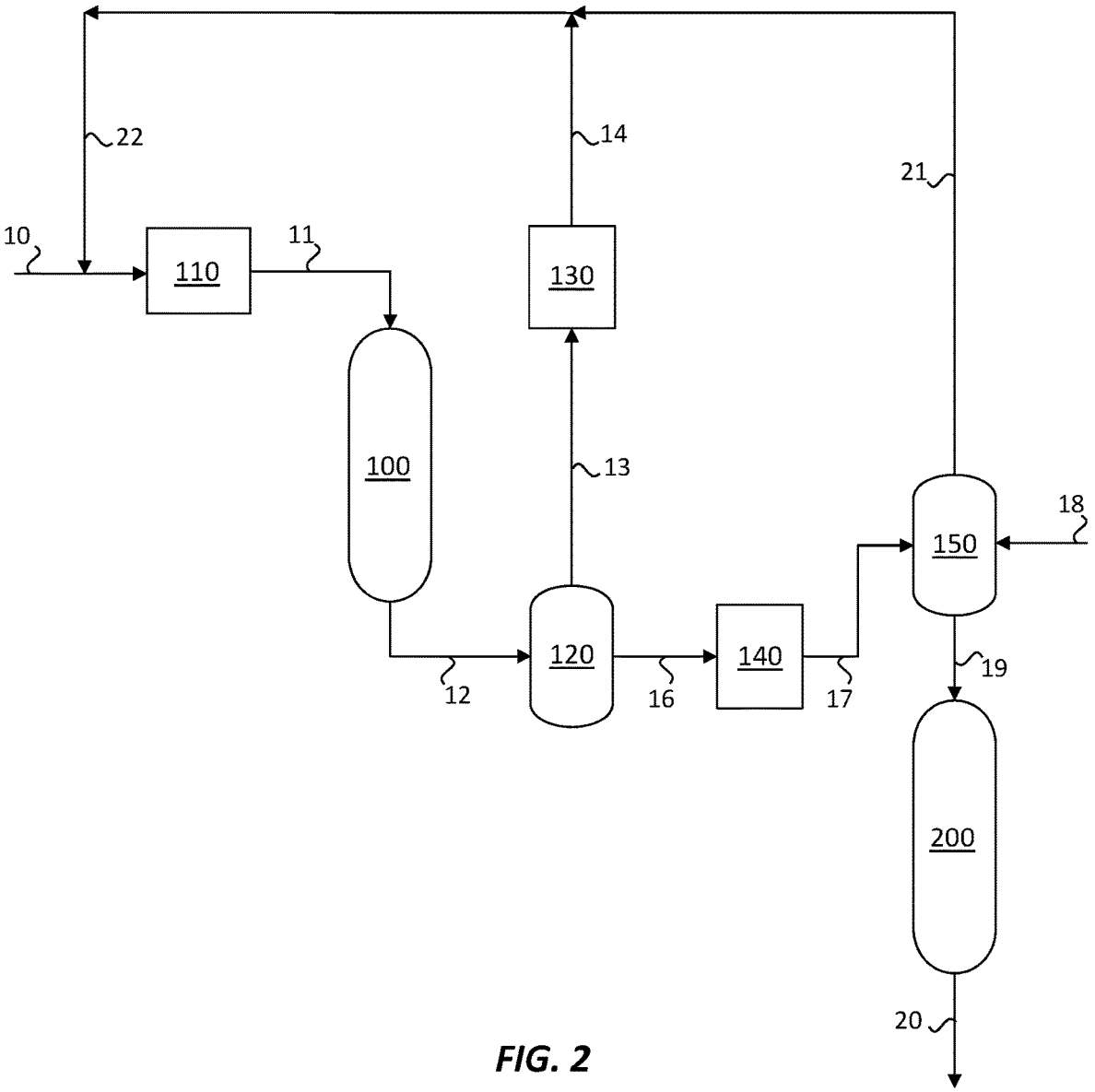
FIG. 2 is a schematic illustration depicting a process and system of one or more embodiments of the present disclosure.

FIG. 2 depicts a process and a system of one or more embodiments of the present disclosure, the system comprising a feedstock heater 110, a first-stage hydrotreating reactor 100, a liquid separator 120, a gas-sweetening system 130, a stripper 140, a hydrogen saturator 150, and a second-stage hydrotreating reactor 200. It is noted that components 100 and 200, and streams 10, and 20 are the same as discussed above with regard to FIG. 1. The hydrotreating processes/reactors and the composition and uses of streams 10, and 20 that are employed in the embodiments depicted by FIG. 2, may be consistent with those discussed previously in this disclosure.

In one or more embodiments, the feedstock 10 is mixed with hydrogen gas 22 (as discussed above) and fed to a heater 110. The heater 110 of one or more embodiments may comprise a feed/effluent exchanger and a furnace. The heater 110 heats the feedstock 10 to a reaction temperature of the first-stage hydrotreating process 100. The hydrogen-containing heated feedstock stream 11 is fed to the first hydrotreating reactor 100 where, in one or more embodiments, the hydrocarbon stream is hydrotreated as discussed above.

The first-stage hydrotreating process of one or more embodiments yields a first hydrotreated effluent stream 12. In one or more embodiments, the first hydrotreated effluent stream 12 comprises a liquid hydrocarbon product that contains dissolved hydrogen sulfide and, optionally, ammonia that is produced from the hydrotreating of the sulfur and/or nitrogen components of the feedstock 10. The stream 12 of one or more embodiments also contains unreacted hydrogen gas. The first hydrotreated effluent stream 12 of one or more embodiments may optionally be cooled by being passed back through the heater 110, transferring heat to a different portion of the feedstock 10.

In one or more embodiments, the first hydrotreated effluent stream 12 is then subjected to a gas-liquid separation process 120. In one or more embodiments, the liquid separator 120 may comprise a fractionator column that separates light gases 13 (such as $C_{1-4}$ hydrocarbons, ammonia, and hydrogen sulphide) from the heavier, liquid distillates 16 (such as naphtha, kerosene and diesel products).

The light gas stream 13 of one or more embodiments is fed to a gas sweetener 130 to isolate the hydrogen gas from the hydrogen sulfide and other light gases. The gas sweetener 130 of one or more embodiments may comprise an absorbing column. The absorbing column may include an amine unit for scrubbing hydrogen sulfide. In one or more embodiments, the hydrogen gas stream 14 that results is recycled 22 and mixed with a different portion of the feedstock 10. The hydrogen gas stream 14 of one or more embodiments may contain hydrogen sulfide in an amount of 1000 ppmw or more, if a sulfided hydrotreating catalyst is used, to keep the catalyst in a sulfided state.

The liquid stream 16 of one or more embodiments is stripped in a stripper 140, to physically separate any remaining hydrogen sulfide from the liquid stream by the application of a vapor stream (not shown). The high boiling fraction ("stripper bottoms") is removed from the stripper 140 as liquid hydrocarbon stream 17. In some embodiments, the vapor stream used for the stripping may comprise one or more of the group consisting of $C_1$ to $C_4$ hydrocarbons, hydrogen, nitrogen, and steam. Steam is used in particular embodiments. In one or more embodiments, stripping may comprise a reboiler to heat the vapor stream. However, one of ordinary skill in the art would appreciate, with the benefit of this disclosure, that the selection of the vapor stream is dependent upon both the composition of the liquid stream, and the identity of the desired top portion. During stripping, the liquid stream 16 and vapor stream may flow either co-currently or counter-currently.

In one or more embodiments, the stripping may be performed at a temperature in the range of from about 20° C. to about 200° C. and at an operating pressure in the range of from about 1 bar to about 10 bars, and in certain embodiments, about 1 bar to 3 bars. The stripping of the present disclosure may be performed in any suitable stripping unit 140 that is known to one of ordinary skill in the art. In one or more embodiments, the stripping units may comprise one or more "continuous contact extractors" such as centrifugal contactors and contacting columns such as tray columns, spray columns, packed towers, rotating disc contactors and pulse columns.

The liquid hydrocarbon stream 17 of one or more embodiments is passed to a hydrogen saturator 150. In the saturator 150, make-up hydrogen 18 is mixed with, and dissolved in, the liquid hydrocarbon 17 to give a hydrogen-saturated hydrocarbon stream 19. The excess hydrogen gas 21 is recycled 22 and mixed with a different portion of the feedstock 10.

The hydrogen saturator 150 of one or more embodiments may be a static mixer where a high flow velocity of liquid and gas are well-mixed to maximize the solubility of hydrogen in the liquid hydrocarbon. The hydrogen saturator 150 of one or more embodiments may be an absorbing column filled with packing materials to maximize the contact surface between hydrogen gas and liquid hydrocarbon. In the column of some embodiments, the liquid hydrocarbon and hydrogen gas may flow either co-currently or counter-currently. The outlet liquid hydrocarbon 17 of one or more embodiments is fully saturated with hydrogen gas.

The hydrogen-saturated hydrocarbon stream 19 of one or more embodiments is passed to a second-stage hydrotreating process 200, as described previously, which provides a second hydrotreated effluent stream 20. In some embodiments, the stream 20 may be treated by a suitable process known to one of ordinary skill in the art. In some embodiments, the second hydrotreated effluent stream 20 is processed in the same way as the first hydrotreated effluent stream 20, and is cooled, separated 120, and stripped 140, to provide a product stream that has an ultra-low sulfur content. As discussed before, the second hydrotreated effluent stream 20 of one or more embodiments may have a significantly lower sulfur content than the feedstock 10 and the first hydrotreated effluent stream 15. In one or more embodiments, the stream 20 may have a sulfur content of less than 100 ppmw, of less than 10 ppmw, of less than 5 ppmw, or of less than 1 ppmw.

Figure 3:
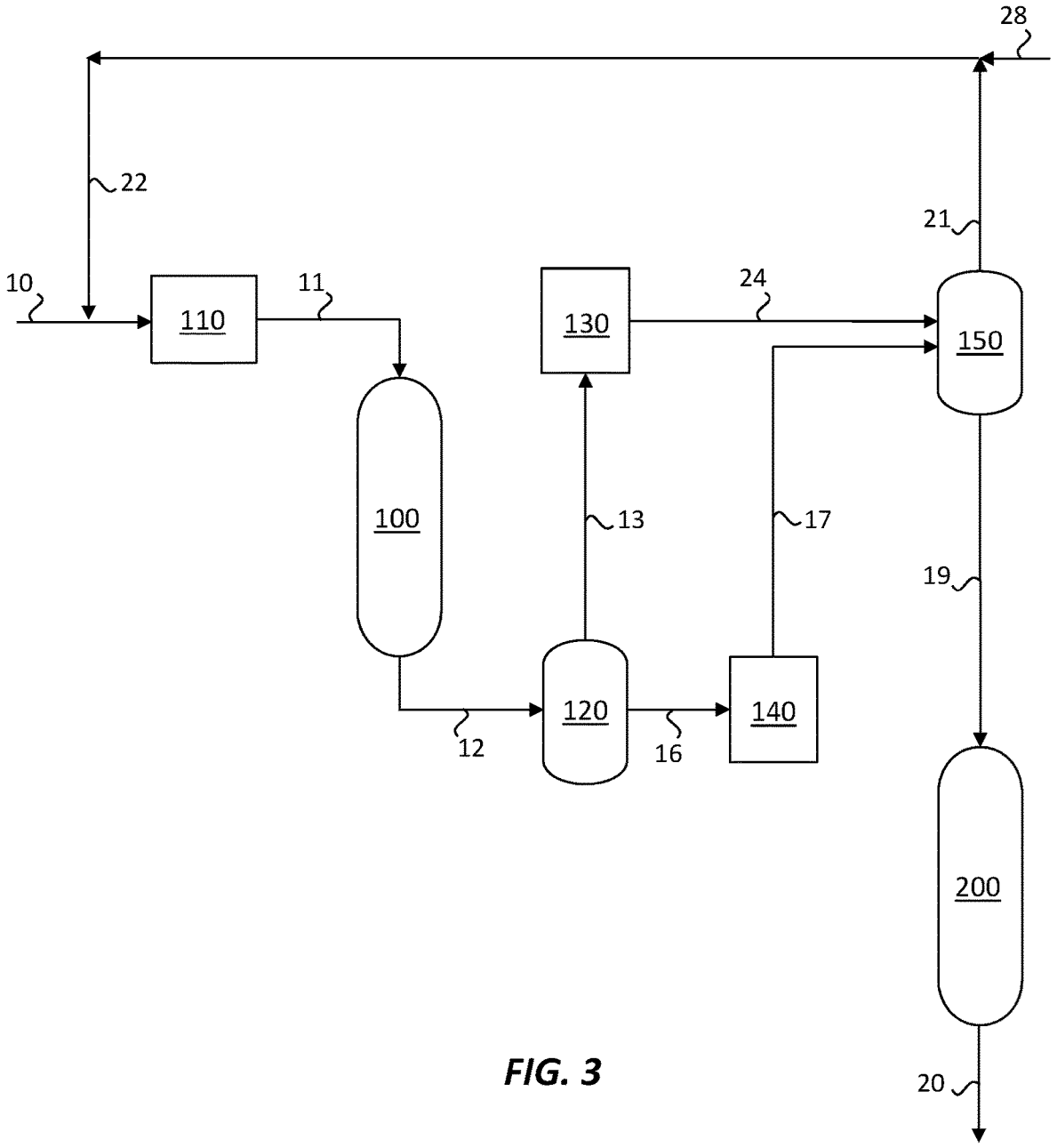
FIG. 3 is a schematic illustration depicting a process and system of one or more embodiments of the present disclosure.

FIG. 3 depicts a process and a system of one or more embodiments of the present disclosure, the system comprising a feedstock heater 110, a first-stage hydrotreating reactor 100, a liquid separator 120, a gas-sweetening system 130, a stripper 140, a hydrogen saturator 150, and a second-stage hydrotreating reactor 200. It is noted that components 100 and 200, and streams 10-13, 16-17, and 19-21 are the same as discussed above with regard to FIG. 1. The components/processes 100, 110, 120, 130, 140, 150, and 200, and the composition and uses of streams 10-13, 16-17, and 19-21 that are employed in the embodiments depicted by FIG. 3, may be consistent with those discussed previously in this disclosure.

Generally, the processes and systems represented by FIG. 3 differ from those represented by FIG. 2, discussed above, in that, the hydrogen gas stream 24 is fed to the hydrogen saturator 150 to replace at least a portion of the make-up hydrogen stream 18. In one or more embodiments, the hydrogen fed to the hydrogen saturator consists essentially of, or in some embodiments consists of, hydrogen from stream 24. In one or more embodiments, fresh make-up hydrogen 28 may be added to the excess hydrogen gas 21 from the hydrogen saturator 150 that is recycled 22 and mixed with a different portion of the feedstock 10.

Examples

The following examples are merely illustrative and should not be interpreted as limiting the scope of the present disclosure.

Examples are provided below to illustrate the impact of using a three-phase process and a two-phase process, in conjunction and in that order, on hydrotreating performance. The composition and properties of the feedstock is given in Table 1.

Example 1: A feedstock in the range of from 180° C.-370° C., the properties of which are given in Table 1, was hydrodesulfurized in a single three-phase hydrotreating reactor. To achieve 777 ppmw sulfur diesel oil, the hydrotreater was operated at 320° C., a liquid hourly space velocity of 1.48 $h^{-1}$, hydrogen to oil ratio of 300 $Nm^3/m^3$, and a hydrogen partial pressure of 33 $kg/cm^2$. Table 2 shows the sulfur distribution of the hydrotreated products. As seen, majority of the sulfur remaining in the products are dibenzothiophenes. The calculations show that for a 50,000 BPSD unit, the catalyst requirement for this case is 224 $m^3$.

TABLE 1

Composition of the feedstock

| Property | Unit | Value |
|---|---|---|
| Specific Gravity | | 0.8423 |
| Sulfur | wt. % | 1.31 |
| Nitrogen | ppmw | 71 |
| Simulated Distillation | | |
| Initial Boiling Point | ° C. | 141 |
| 5% | ° C. | 188 |
| 10% | ° C. | 204 |
| 30% | ° C. | 249 |
| 50% | ° C. | 285 |
| 70% | ° C. | 319 |

TABLE 1-continued

Composition of the feedstock

| Property | Unit | Value |
|---|---|---|
| 90% | ° C. | 351 |
| 95% | ° C. | 364 |
| Final Boiling Point | ° C. | 400 |

TABLE 2

Sulfur-containing components of Example 1

| Component | ppmw |
|---|---|
| Benzothiophenes | 53 |
| Dibenzothiophenes | 724 |
| Total | 777 |

Example 2: The same feedstock as Example 1 was hydrodesulfurized in a single three-phase hydrotreating reactor. To achieve <10 ppmw sulfur diesel oil, the hydrotreater had to be operated at 359° C., a liquid hourly space velocity of 1.48 $h^{-1}$, hydrogen to oil ratio of 300 $Nm^3/m^3$ and hydrogen partial pressure of 33 $kg/cm^2$. If the temperature window is limited, an additional reactor can be added to achieve the same conversion level. This results in a LHSV of 0.602 $h^{-1}$. It is calculated that for a 50,000 BPSD day unit, the catalyst requirement is 550 $m^3$, which is twice as much the volume of the catalyst used in example 1.

Example 3: The same feedstock as Examples 1-2 was hydrodesulfurized in a two-stage unit with a first stage reactor operating in three phase and a second stage reactor operating in two phase. The first stage is operated as in example 1 at 320° C., a liquid hourly space velocity of 1.48 $h^{-1}$, hydrogen to oil ratio of 300 $Nm^3/m^3$ and hydrogen partial pressure of 33 $kg/cm^2$. It is calculated that for a 50,000 BPSD day unit, the catalyst requirement for the first stage reactor is 224 $m^3$. After stripping the light gases (C1-C4), hydrogen sulfide and ammonia, the liquids (stripper bottoms) containing 777 ppmw of sulfur is sent to the second stage reactor to obtain <10 ppmw of sulfur. The stripper bottoms stream was pre-saturated with gas phase hydrogen in a mixer before the second reactor. The hydrogen requirement calculations are shown in example 4. The second reactor was operated in two-phase with hydrogen in liquid phase at 320° C., hydrogen to oil ratio of 300 $Nm^3/m^3$, and pressure of 33 $kg/cm^2$ but at 55% more LHSV or 55% less catalyst volume. The LHSV requirement for the second stage reactor is 2.6 $h^{-1}$ resulting in a catalyst volume of 123 $m^3$. The total catalyst volume requirement is 347 $m^3$. The two-stage process saved 203 $m^3$ of catalyst.

The hydrogen requirement for Examples 1-3 is calculated in Table 3 as per the following reaction: $SR_2+2H_2 \rightarrow H_2S+R_2$ (I)

TABLE 3

Calculating hydrogen requirement for Examples 1-3

| Content | Unit | Value |
|---|---|---|
| Sulfur | mg/kg | 777 |
| Sulfur | moles/kg | 777 mg/1000 g/mg/32 g/gmol = 0.02428 |
| Hydrogen sulfide | moles/kg | 0.02428 |
| Hydrogen | moles/kg | 0.02428 × 2 = 0.04856 |
| Hydrogen | g/kg | 0.04856 × 2.014 = 0.0977 |

As seen above, to remove 777 ppmw of sulfur, 0.0977 g/kg of hydrogen is required. Process simulations using ASPEN software showed that hydrogen in solution is 0.75 g/kg feedstock, which is more than the hydrogen consumed in the system. The dissolved hydrogen in the feedstock is 0.063 wt. %, which is sufficient for desulfurization.

Advantageously, embodiments of the present disclosure enable reduced hydrogen consumption and more mild reaction conditions, such as one or more of a reduced reactor temperature, a reduced catalyst volume requirement, and an elongated catalyst cycle length. The amount of recycled hydrogen gas needed for this process is greatly decreased, reducing energy cost for compressing and recirculating large amount of hydrogen gas.

These advantageous effects are provided by the specific order of the hydrotreating stages. Performing two-phase hydrotreating in the second stage is beneficial as refractory sulfur compounds are more reactive under two phase conditions than three-phase. Moreover, the supply of hydrogen to a two-phase system is limited by the solubility of the hydrogen. Since hydrogen consumption is reduced in the second step as there are fewer sulfur molecules (as the first hydrotreating process removes a substantial majority of the sulfur components), the amount of hydrogen that is dissolved in the two-phase system is sufficient for further desulfurization, and there is no need to recycle liquid back to the reactor to dissolve more hydrogen. The hydrogen supply is not as limited in the three-phase process of the first stage, meaning that a substantial amount of sulfur can be readily removed.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A process for hydrotreating a sulfur-containing hydrocarbon feedstock, the process comprising:

hydrotreating the feedstock in a three-phase trickle reactor to remove a first portion of the sulfur from the feedstock, to produce a hydrotreated effluent;

separating the first hydrotreated effluent in a gas-liquid separation process downstream of the three-phase trickle reactor to give a hydrogen-containing gaseous fraction and a separated hydrotreated effluent;

stripping the separated hydrotreated effluent in a stripper downstream of the gas-liquid separation process to give a hydrogen sulfide-containing gaseous fraction and a stripped hydrotreated liquid effluent;

saturating the stripped hydrotreated liquid effluent in a hydrogen saturator downstream of the stripper with hydrogen to produce a hydrogen-saturated effluent; and hydrotreating the hydrogen-saturated effluent in a two-phase reactor downstream of the hydrogen saturator to remove a remaining second portion of the sulfur and produce a second hydrotreated effluent;

wherein the process is a single-pass hydrocarbon process, and wherein an entire amount of the stripped hydrotreated liquid effluent is passed from the stripper to the hydrogen saturator.

2. The process of claim 1, further comprising mixing the feedstock with hydrogen gas and heating the mixture in a heater prior to the hydrotreating.

3. The process of claim 1, wherein the stripping is steam-stripping or stripping with a gas that is heated by a reboiler.

4. The process of claim 1, further comprising separating the second hydrotreated effluent to give a second hydrogen-containing gaseous fraction and a second separated hydrotreated effluent.

5. The process of claim 4, further comprising stripping the second hydrotreated effluent to give a second hydrogen-containing gaseous fraction and a second stripped hydrotreated liquid effluent.

6. The process of claim 1, wherein the stripped hydrotreated liquid effluent has a sulfur content that ranges from 100 to 1000 ppmw.

7. The process of claim 5, wherein the second stripped hydrotreated liquid effluent has a sulfur content of 10 ppmw or less.

8. A process for hydrotreating a sulfur-containing hydrocarbon feedstock, the process comprising:

hydrotreating a mixture of the feedstock and hydrogen in a three-phase trickle reactor to remove a first portion of the sulfur from the feedstock, to produce a first hydrotreated effluent;

separating the first hydrotreated effluent in a gas-liquid separation process downstream of the three-phase trickle reactor to give a hydrogen-containing gaseous fraction and a separated hydrotreated effluent;

purifying the hydrogen-containing gaseous fraction in a gas-sweetening system downstream of the gas-liquid separation process to produce a recycled hydrogen stream that is mixed with the feedstock upstream of the three-phase trickle reactor;

stripping the separated hydrotreated effluent in a stripper downstream of the gas-liquid separation process to give a hydrogen sulfide-containing gaseous fraction and a stripped hydrotreated liquid effluent;

saturating the stripped hydrotreated liquid effluent in a hydrogen saturator downstream of the stripper with hydrogen that comprises fresh make-up hydrogen to produce both hydrogen-saturated effluent and a second recycled hydrogen stream that is mixed with the feedstock upstream of the three-phase trickle reactor; and hydrotreating the hydrogen-saturated effluent in a two-phase reactor downstream of the hydrogen saturator to remove a remaining second portion of the sulfur and produce a second hydrotreated effluent;

wherein the process is a single-pass hydrocarbon process, and wherein an entire amount of the stripped hydrotreated liquid effluent is passed from the stripper to the hydrogen saturator.

9. The process of claim 8, further comprising heating the mixture of the feedstock and hydrogen in a heater prior to the hydrotreating.

10. The process of claim 8, further comprising separating the second hydrotreated effluent to give a second hydrogen-containing gaseous fraction and a second separated hydrotreated effluent.

11. The process of claim 10, further comprising stripping the second hydrotreated effluent to give a second hydrogen-containing gaseous fraction and a second stripped hydrotreated liquid effluent.

12. The process of claim 8, wherein the stripped hydrotreated liquid effluent has a sulfur content that ranges from 100 to 1000 ppmw.

13. The process of claim 11, wherein the second stripped hydrotreated liquid effluent has a sulfur content of 10 ppmw or less.

14. A process for hydrotreating a sulfur-containing hydrocarbon feedstock, the process comprising:

hydrotreating the feedstock in a three-phase trickle reactor to remove a first portion of the sulfur from the feedstock, to produce a first hydrotreated effluent;

separating the first hydrotreated effluent in a gas-liquid separation process downstream of the three-phase trickle reactor to give a hydrogen-containing gaseous fraction and a separated hydrotreated effluent;

purifying the hydrogen-containing gaseous fraction in a gas-sweetening system downstream of the gas-liquid separation process to produce a first hydrogen stream;

stripping the separated hydrotreated effluent in a stripper downstream of the gas-liquid separation process to give a hydrogen sulfide-containing gaseous fraction and a stripped hydrotreated liquid effluent;

saturating the stripped hydrotreated liquid effluent in a hydrogen saturator downstream of both the stripper and the gas-sweetening system with hydrogen that comprises at least a portion of the first hydrogen stream to produce both a hydrogen-saturated effluent and a recycle hydrogen stream that is mixed with the feedstock upstream of the three-phase trickle reactor; and hydrotreating the hydrogen-saturated effluent in a two-phase reactor downstream of the hydrogen saturator to remove a remaining second portion of the sulfur and produce a second hydrotreated effluent;

wherein the process is a single-pass hydrocarbon process, and wherein an entire amount of the stripped hydrotreated liquid effluent is passed from the stripper to the hydrogen saturator.

15. The process of claim 14, further comprising heating the mixture of the feedstock and hydrogen in a heater prior to the hydrotreating.

16. The process of claim 14, further comprising separating the second hydrotreated effluent to give a second hydrogen-containing gaseous fraction and a second separated hydrotreated effluent.

17. The process of claim 16, further comprising stripping the second hydrotreated effluent to give a second hydrogen-containing gaseous fraction and a second stripped hydrotreated liquid effluent.

18. The process of claim 14, wherein the stripped hydrotreated liquid effluent has a sulfur content that ranges from 100 to 1000 ppmw.

19. The process of claim 17, wherein the second stripped hydrotreated liquid effluent has a sulfur content of 10 ppmw or less.

20. The process of claim 14, wherein the stripped hydrotreated liquid effluent is saturated with hydrogen that consists of the first hydrogen stream.

* * * * *